United States Patent [19]

Winrow

[11] 4,223,464

[45] Sep. 23, 1980

[54] DISPLAY OR INDICATOR ELEMENT

[75] Inventor: Donald Winrow, Weston, Canada

[73] Assignee: Ferranti-Packard Limited, Mississauga, Canada

[21] Appl. No.: 22,790

[22] Filed: Mar. 22, 1979

[51] Int. Cl.[2] ..... G09F 9/37

[52] U.S. Cl. ..... 40/449; 340/764; 40/450

[58] Field of Search ..... 40/449, 450, 451; 340/378.2, 763, 764, 756, 783; 58/126 E

[56] References Cited

U.S. PATENT DOCUMENTS

| | | | |
|---|---|---|---|
| 755,272 | 3/1904 | Burnham | 40/450 |
| 1,357,457 | 11/1920 | Jorgensen | 40/450 |
| 3,025,512 | 3/1962 | Bioechi | 340/378.2 |
| 3,096,594 | 7/1963 | Skobrisch | 40/449 |
| 3,199,098 | 8/1965 | Schwartz | 340/764 |
| 3,303,654 | 2/1967 | Taylor | 40/450 X |
| 3,365,824 | 1/1968 | Winrow | 40/449 |
| 3,469,258 | 9/1969 | Winrow | 340/783 |
| 3,537,197 | 11/1970 | Smith | 40/449 |
| 3,624,647 | 11/1971 | Smith | 340/373 |
| 3,624,941 | 12/1971 | Chantry | 40/449 |
| 3,965,668 | 6/1976 | Tomokazu | 58/126 E |
| 3,975,728 | 8/1976 | Winrow | 40/449 X |
| 3,991,496 | 11/1976 | Heiwig | 40/449 |
| 3,996,680 | 12/1976 | Smith | 40/449 |
| 4,024,532 | 5/1977 | Serwin | 340/764 |
| 4,040,193 | 8/1977 | Matsuda | 40/449 |

*Primary Examiner*—Louis G. Mancene
*Assistant Examiner*—Wenceslao J. Contreras

[57] ABSTRACT

A display element is mounted on a base to rotate less than 180° between two limiting positions and to create mutually contrasting effects in the two positions. A magnetizable element mounted on the base extends parallel to the axis of rotation and exerts rotational torque at each of its free ends on one of two permanent magnets mounted on the display element to rotate outside of the free ends.

7 Claims, 7 Drawing Figures

DISPLAY OR INDICATOR ELEMENT

Figure 1:
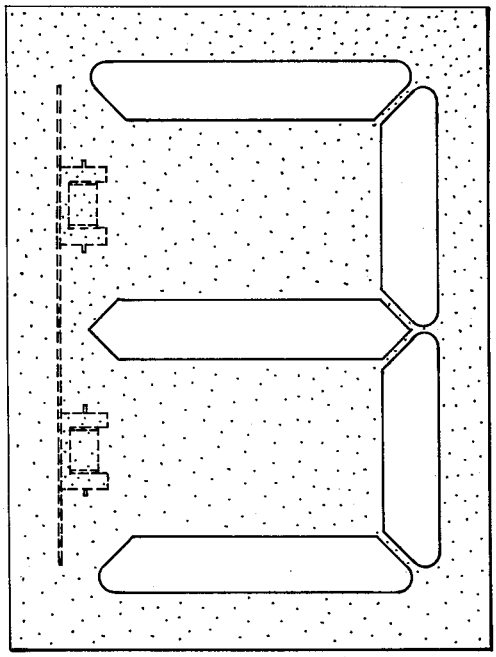

This invention relates to means for driving a rotatably or swingably mounted display element.

The display elements or indications with which the invention is concerned are those which move between the two limiting positions.

Such display elements in one limiting position display, in a viewing direction, a surface of one color in the viewing direction, while in the other limiting position they are arranged so that a contrasting color is displayed in the viewing direction at the location where the surface was displayed. Examples of such display elements usually having the form of a bar where the two limiting positions are 90°-120° apart and where the contrasting color in the second limiting position is due to the occlusion or substantial non-visibility of the contrasting face are:

| U.S. Pat. No. | Inventor | Date |
|---|---|---|
| 3,537,197 | C.N. Smith | Nov 3, 1970 |
| 3,624,647 | C. N. Smith | Nov 30, 1971 |

Examples of such display elements (usually in the form of a round dot) where the two limiting positions are 165°-180° apart and the contrasting color in the second limiting position is due to a contrasting color on the opposite side of the element from the face are:

| U.S. Pat. No. | Inventor | Date |
|---|---|---|
| 3,303,654 | M. K. Taylor | Feb 7, 1967 |
| Des.241,081 | Winrow | Aug 17, 1976 |
| 3,991,496 | Gordon Helwig et al | Nov 16, 1976 |
| 3,624,941 | S. W. F. Chantry | Dec 7, 1971 |
| 3,365,824 | D. Winrow | Jan 30, 1968 |
| 3,996,680 | C. N. Smith | Dec 14, 1976 |
| 3,975,728 | D. Winrow | Aug 17, 1976 |
| 3,469,258 | D. Winrow | Sept 23, 1969 |

The above patents also represent the most relevant prior art known to applicant.

The invention provides a mounting base wherein a pair of reversible, permanently magnetizable members, also referred to as 'cores' herein, are arranged to provide, between the free ends of each of the members, when the two magnetizable members are oppositely polarized, a gap creating a magnetic flux field of predetermined orientation and selectable polarity. It will be noted that the polarity of each flux field may be reversed by reversal of the magnetization of both the respective oppositely magnetized members. The display element is rotatably mounted to rotate through a permitted arc of rotation (less than 180°) relative to said mount. A pair of permanent magnets mounted thereon for rotation therewith rotate, one in each flux field. The orientation of the magnets is chosen relative to the permitted arc of rotation of the element so that on magnetization, in one sense of the reversible elements, the magnets will rotate the display element from one limiting position to the other and on magnetization in the other sense, the magnets will rotate the display element from the other limiting position to the one. As explained in a number of the prior patents, the use of reversible permanently magnetizable core material allows the use of a short duration pulse to set the magnetization of a magnetic member and does not require a sustaining current.

The principal advantages of this invention accrue from it's arrangement in having pairs of magnetizable core free ends outwardly directed on opposite sides of a projecting mounting base, in cooperation with two magnets on the rotating element, each magnet being located outwardly of a pair of said free ends.

The rotatable display or indicating element is provided with a pair of ears which extend on each outer side of the respective pairs of core ends. A pivoted mounting for the display element is provided, located so that the rotation axis in the vicinity of each of the gaps between the core ends and preferably midway across each such gap. Permanent magnets are mounted on each of said ears having magnetic polar axes with a substantial component transverse to the axis of rotation and adjacent and preferably intersecting the axis of rotation.

The two magnets each therefore rotate on a locus outwardly of the free ends of the cores although in their flux fields. This has the result that, with the rotatable element in one limiting position, under the influence of the magnetic flux from the cores, the maximum magnetic attractive force is developed between the movable rotary magnets and the stationary core members. However, thereafter, when the core members are pulsed to reverse their respective magnetism, the reversed field (in accord with the relative orientation of the rotary magnets and the pole pieces at the limiting position) will cause rotation of the display element and rotary magnets to the other limiting position. At the same time, a large repelling force develops between each rotary magnet and the inwardly located core ends. Since this repelling force varies inversely as the distance between each magnet and the corresponding core member ends, the rotary member is automatically self centering relative to the mount and frictional resistance to rotation of the rotary element is minimized. It will be appreciated that, with the inventive design, such self-centering occurs only during the first portion of the movement of the rotary member from one limiting position toward the other. (After completion of such first portion of the movement the main forces on the rotating element magnets are attractive so that the self centering effect is not present). Nevertheless, the self centering effect during the first portion of such movement reduces or eliminates friction during the start up and initial acceleration of the rotary element. Thus one of the major causes of malfunction of electro-magnetically operated signs, frictional interference to rotation, is materially reduced by this arrangement. This development also provides better rotary operation than the devices shown in the previous patent lists since the present development provides the increased torque from two magnets operating in two flux gaps.

The length of the lists of patents at the beginning of this application may be slightly misleading in one respect. The invention is believed to be of most immediate application to those display or indicating elements where the element rotates about 90°-110°, as exemplified by the display elements in U.S. Pat. Nos. 3,537,197 and 3,624,647. With such devices the rotation of about 100° in a field which may reverse, (i.e. alter 180°) means that the angle between permanent magnet and external field at each limiting position may be $$\frac{180^\circ - 100^\circ}{2} = 35^\circ$$

which gives good starting torque. The invention is also applicable to the disc type display elements exemplified by the longer list of patents as long as the rotation is limited to less than 180°. However it is not believed that the invention will be a commonly used in devices where the rotation is between 170° and 180° because:

(a) of the expense and complexity in designing the mount to permit this degree of rotation and (b) of the low starting torque In drawings which illustrate a preferred embodiment of the invention:

The invention also extends to the construction previously described where only a single straight magnetizable core is used instead of two. The single core is located so that the two permanent magnets rotating with the display element are located in the flux fields located at the ends of the single core. The single core is located and the permanent magnets are oriented so that the reversal of its magnetism will move the permanent magnets and hence the display element from one limiting position to the other. This embodiment is much less preferable than the two core form previously described. It may be arranged with the permanent magnets outwardly of the core ends to produce a self-centering effect at the beginning of element movement. However the starting and over all torques to move the display element are substantially less than when two cores are used.

Figure 2:
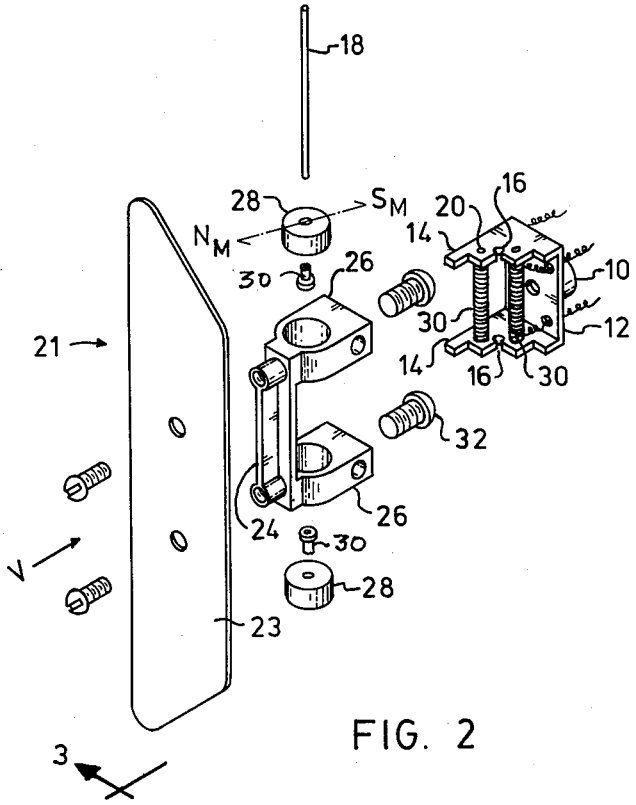
Figure 3:
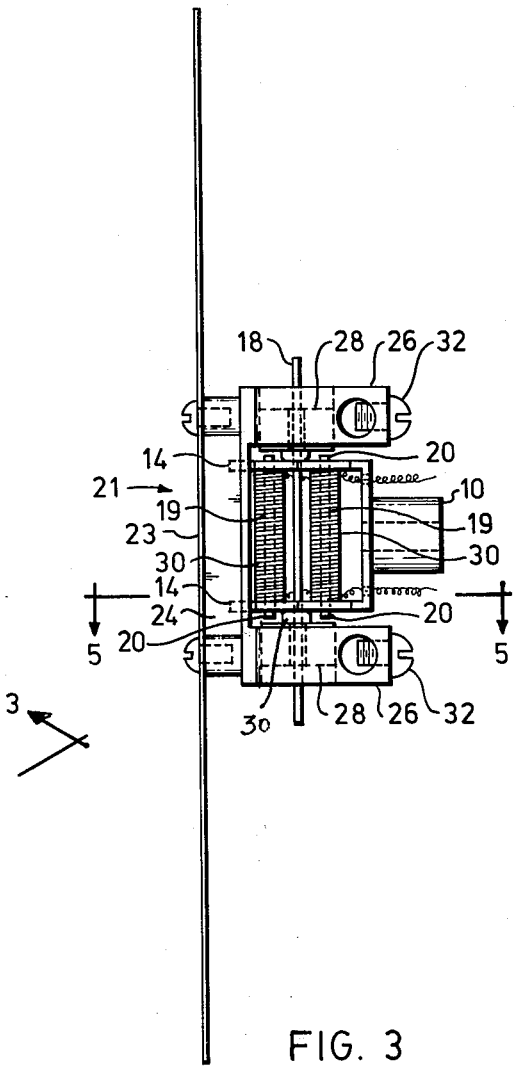
Figure 5:
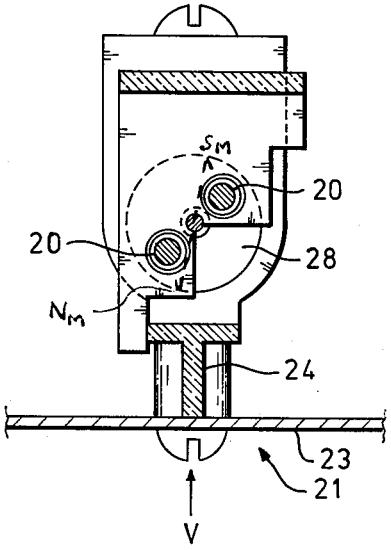
Figure 4:
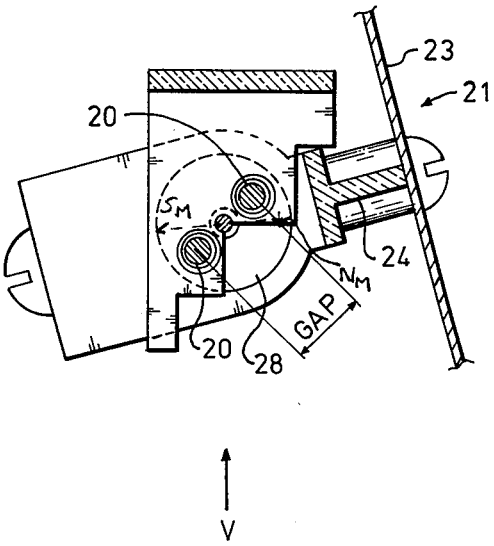
Figure 7:
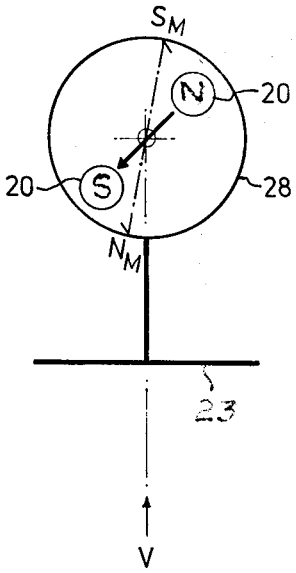
Figure 6:
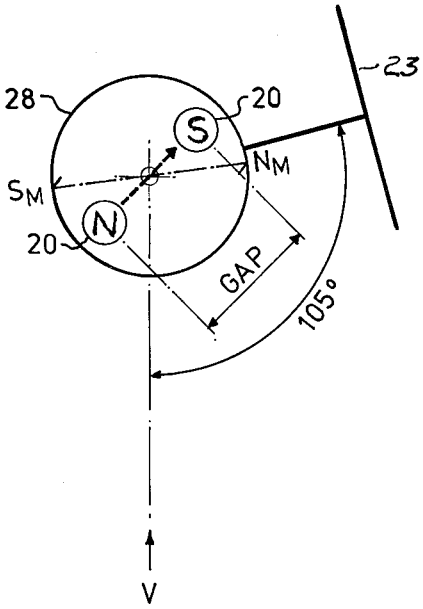

FIG. 1 shows schematically an array of seven elements in accord with the invention forming the numeral '3', FIG. 2 shows an exploded view of a display or indicating element in accord with the invention, FIG. 3 shows an assembled, side view of the elements of FIG. 2, FIG. 4 shows a schematic view of the element at one limiting position, FIG. 5 shows a schematic view of the element at the other limiting position (corresponding to that of FIG. 2), FIG. 6 shows the magnetic interaction of flux field and permanent magnet in the position corresponding to FIG. 4; and FIG. 7 shows the magnetic interaction of flux field and permanent magnet in the position corresponding to FIG. 5.

In the drawings, FIG. 1 schematically represents an example of a seven bar (i.e. using seven display elements) module. The module displays the numeral 3. As is customary the mounting means and background for the seven rotatable members is a predetermined color, preferably black, and defines seven slots or recesses in the general shape of a rectangular FIG. "8". Corresponding to each slot or recess is a rotatable display element rotatable through an angle of about 90° or slightly greater. The element moves between two limiting positions in either of which it remains stationary. In one of such positions the element displays a face contrasting with the background. In the other position the orientation and coloring is chosen so that the element (usually edge on in the viewing direction in this arrangement) is comparatively non-distinguishable from the background. Thus in FIGS. 1, five elements are in the contrasting position and two which are comparatively non-distinguishable from (or match with) the background together produce the numeral "3".

The general construction of the module shown in FIG. 1 is not shown in detail as it is well known to those skilled in the art and exemplified in the devices shown in U.S. Pat. Nos. 3,537,197 and 3,624,647.

In FIG. 2, one of the bar elements and its mounting constructed in accord with the invention is shown in detail. The stationary portion or stator will be described first. As shown, a post 10 is provided mountable on a base plate (not shown) to project in the viewing direction 'V'. A bracket 12 having parallel plates 14 extending in the viewing direction is mounted on the outer end of the post 10. The edge on the same side of each plate 14 is stepped, as hereafter described, and at the root of a step approximating the median of each plate 14 (between opposed edges) a recess 16 is shaped to allow the rotating element spindle 18 to be snapped thereinto. A pair of reversible permanently magnetizable core rods 19 are mounted to extend between the plates and terminate in free ends 20 projecting through apertures in the plates.

The apertures provide through the use of friction fit or adhesive or equivalent means, the means whereby the core members 18 are maintained in position. The core rods 18 are preferably flush with or project very slightly beyond the outer surfaces of the plates 14. To avoid eddy current or magnetic shielding effects, the plates 14 and preferably the bracket 12 and post 10 also are made of plastic.

It will be seen that when the two core rods 18 are magnetized in opposite senses the gaps between the pole piece ends are gaps in a magnetic circuit and provide a flux field extending across the gaps and outwardly of the respective plates. Opposite polarities of such flux field (indicated by the letters N and S are indicated in FIGS. 6 and 7). The polarities N, S of the flux field correspond to the rest position of the element in FIGS. 6 and 7. When the flux field polarities are reversed to initiate movement to the opposite limiting position the polarities will be the reverse of that shown.

The rotor will now be described.

A display or indicating element 21 is provided of wide area and having one surface 23 contrasting with mounting and the background (not shown). The display element is mounted with its one face 23 outwardly directed, on a bar 24 which is provided with two ears 26 designed to extend on each side of the bracket plates 14. The ears 26 each mount permanent magnets 28 which are apertured to receive and rotate on or with the spindle 18. The magnets 28 are attached with adhesive or friction fitted in apertures in ears 26 and magnets 28 are apertured to receive low friction inserts 30 which are bored to receive the spindle 18. The permanent magnets 28 are selected and oriented so that their magnetic axes (indicated by the line $S_M$-$N_M$) have a substantial component transverse to the axis of rotation of the rotor. Cooperating surfaces on the steps of plate 14 and on the bar 24 limit the rotation of the display element to that between two limiting positions. This is best shown in FIGS. 4 and 5. In the preferred embodiment this is approximately 105°. In one of these limiting positions, the surface 23 faces in the viewing direction and in the other limiting position (about 105° displaced therefrom) the surface 23 is approximately edge-on to the viewing direction V and in fact a small projection of the opposite non-contrasting side of display element 21 is displayed. The orientation of the magnets 28 relative to the orientation of the gap is demonstrated in FIGS. 6 and 7 where, in a view along the pivotal axis, one gap between core ends 20 and the magnet 28 influenced by the flux across the gap is shown.

As shown in FIG. 6 when the sense of the reversible field S-N is upward and to the right, across the gap, due to the sense of magnetization of the core members; then the display element rotates to the position indicated in FIG. 6 so that its polar axis $S_M$-$N_M$ can (as closely as permitted by the relevant stop) try to align with the field S-N. In this orientation, as indicated in FIG. 6, the contrasting side 23 of the display element is obscured in the viewing direction 'V'. When the field as shown in FIG. 6 is reversed due to energization in the respective opposite sense of both cores 19, the field is the reverse of that shown in FIG. 6 and the magnets 28 rotate themselves and the display element to the orientation shown in FIG. 7 so that the axes of magnets 28 is a close to alignment with the new direction of gap field S-N as the mechanical stop will allow. In the orientation of FIG. 7, the display element will expose its contrasting face in the viewing direction. By reversing the field as shown in FIG. 7, the display element will be rotated back to the position of FIG. 6. In the preferred embodiment, in either orientation of the display element, it will be seen that on initial reversal of the gap field, the angle between the magnet field $S_M$-$N_M$ and the gap field S-N $$\left(\text{approximately } \frac{180^\circ - 105^\circ}{2} = 37.50^\circ\right)$$

provides a relatively high, and quite adequate, starting torque. One of the advantages of the present invention is that such starting torque is applied at each axial end of the rotating element giving a high torque. It will be obvious that the actual orientation of the core ends defining a core gap and of the corresponding permanent magnet 28 in its limiting positions is not important, but only the relative positions of these elements. Such relative positions are chosen so that the torque exerted by the gap field on its corresponding magnet will be in the same direction for travel of the corresponding magnet 28 through its permitted range of orientations and, of course the torque will be in the same sense for both magnets 28 for a given sense of magnetization of the oppositely magnetized cores.

It will further be noted that if the relative positions of magnet and field at each end are correct, the fields at opposed ends of the cores and at opposite permanent magnet limiting positions need not be parallel. However, in practice, the core members 19 will be straight, parallel, pieces of stock, arranged parallel to the axis of rotation, which are cheap and convenient to wind with energizing windings. Thus these pole pieces will define, in the preferred embodiment, gaps with parallel orientation at each end. The permanent magnet magnetic axes therefore will be similarly parallel.

As shown in FIGS. 2 and 3 the cores 19 are provided with energizing windings 30 for pulsing them when required, in the desired opposite sense of magnetization. Relatively large adjustable bolts 32 are provided which are mounted in threaded bores in each ear 26 and may be adjusted to partly counterbalance the weight of the display element and its mounting.

The cores 19 are assembled to the bracket 12 as follows: The cores 19 are, wound when separated from the core. The windings 30 are applied by means skilled in the art and the insulating coatings are preferably bonded so that the wound coil is bonded into a unitary body, also as well known to those skilled in the art. The core ends 20 project from both ends of the winding. The plates 14 of bracket 12 are made of resilient plastic and are made flexible enough so that they may be spread sufficiently to allow the insertion of the projection ends of the core 19 in the apertures in plates 14. After such insertion the plates 14 are allowed to flex back to their unstressed position retaining the respective cores in position.

In operation, the two cores 19 will be oppositely magnetized in predetermined senses with their field acting to hold the display element at one of its limiting positions. Since the forces between a magnet 28 and its corresponding core ends 20 are attractive, the rotary element will usually be held by the magnetic force against one of its bearings and will be slightly spaced from the other one. When it is desired to produce a contrasting appearance by the display element in the viewing direction, both cores 19 are pulsed to reverse their magnetization. The reversed magnetization produce at each pair of ends 20 a force to repel both permanent magnets 28 and, as previously explained, will tend to centre the rotary element relative to the core ends 20 and hence to centre the display bearings relative to the mount. The rotary element will then move to its opposite orientation with the friction reduced by the self centering action.

In the alternative using one core, the arrangement may be visualized by considering the device as illustrated in FIGS. 2–7 but with one of the cores 19 and its winding 30 removed. It will be obvious from consideration of FIGS. 6 and 7 that the device will operate, and from FIG. 3 that the device will be self centering during the first portion of the movement of the display element between positions. On the other hand it will also be obvious that the torque tending to turn the display element will be much less than with the two core construction.

I claim:

1. Display or indicating element including:

a base, a display element rotatably mounted thereon to rotate about an axis of rotation relative thereto, means limiting the rotation of said display element to less than 180° between two limiting positions, said display element being designed to create mutually contrasting effects, in a viewing direction, in said two limiting positions, a pair of reversible permanently magnetizable magnetic elements, each extending between first and second free ends, an electrical energizing coil corresponding to each magnetizable element for magnetizing the latter, said two first free ends defining a first gap between them, having a substantial component transverse to the axis of rotation, said two second ends defining a second gap between them, having a substantial component transverse to the axis of rotation, first and second permanent magnets mounted on and rotatable with said display element, each of said first and second magnets being located and oriented so that for either, opposite magnetization of said magnetizable elements the flux across said gap will exert torque in one sense on the corresponding magnet on rotation of said magnet over said range of movement and so that said torque will be in the same sense for both magnets.

2. Display or indicating element including:

a base, a display element rotatably mounted thereon to rotate about an axis of rotation relative thereto, means limiting the rotation of said display element to less than 180°, said display element being designed to create mutually contrasting effects, in a viewing direction, in said two limiting positions, a pair of permanent magnets mounted on said display element for rotation therewith, a pair of stationarily mounted reversibly permanently magnetizable members, an electrical energizing coil corresponding to each magnetizable element for magnetizing the latter, each reversible permanently magnetizable member having first and second free ends, the pair of first free ends and the pair of second free ends each being designed, when each of mutually opposite magnetic polarity, to define a magnetic flux path of reversible polarity, each of said flux paths including the locus of one of said magnets over said rotational range, and being arranged so that, for a given polarity in the gap, each flux field exerts a torque in one sense over the range of movement of the corresponding magnet between two limiting positions, and so that such torque is in the same sense for both magnets.

3. Display or indicating element comprising:

a stator comprising, a projecting mounting, a pair of substantially straight magnetic cores of reversible permanently magnetizable material, means corresponding to each said core for reversibly permanently magnetizing said core, said cores being mounted in parallel arrangement transverse to the projection direction on said mounting to define gaps between pairs of ends thereof adjacent opposed sides of said mounting, a rotor member comprising a display element and a pair of ears located adjacent and outwardly of said mounting on opposite sides thereof, and connected to rotate relative thereto about an axis substantially parallel to said cores, a magnet mounted in each ear to rotate in a locus in the magnetic field created between the corresponding core ends when the magnet cores are oppositely magnetized, means limiting the rotation of said rotor element to less than 180°, said permanent magnets each being oriented to provide so that, with oppositely polarized core members, the flux field at either end thereof will exert torque in the same sense between the limits of movement of the corresponding magnet and in the same sense for both magnets.

4. Display or indicating element as claimed in claim 1 or claim 2 wherein said magnetizable elements are substantially straight magnetic cores.

5. Display or indicating element as claimed in claim 1 or claim 2 wherein each of said first and second magnets are located outwardly of the corresponding two free ends.

6. Display or indicating element including:

a base, a display element rotatably mounted thereon to rotate about an axis of rotation relative thereto, means limiting the rotation of said display element to less than 180° between two limiting positions, said display element being designed to create mutually contrasting effects, in a viewing direction, in said two limiting positions, at least one reversible permanently magnetizable magnetic element, extending between a first and a second free end, an electrical energizing coil corresponding to each magnetizable element for magnetizing the latter, first and second permanent magnets mounted on and rotatable with said display element, respectively outwardly of said first and said second free ends, each of said first and second magnets being located and oriented so that for either, opposite magnetization of said at least one magnetizable element the flux from said magnetizable element end will exert torque in one sense on the corresponding magnet on rotation of said magnet over said range of movement and so that said torque will be in the same sense for both magnets.

7. Display or indicating element comprising:

a stator comprising, a projecting mounting, at least one straight magnetic cores of reversible permanently magnetizable material, means corresponding to each said core for reversibly permanently magnetizing said core, said core being mounted to extend transverse to the projection direction on said mounting to produce a magnetic flux field adjacent the ends thereof adjacent opposed sides of said mounting, a rotor member comprising a display element and a pair of ears located adjacent and outwardly of said mounting on opposite sides thereof, and connected to rotate relative thereto about an axis substantially parallel to said cores, a magnet mounted in each ear to rotate in a locus in the magnetic field adjacent the corresponding core end, means limiting the rotation of said rotor element to less than 180°, said permanent magnets each being oriented to provide so that, the flux field at either end of the core member will exert torque in the same sense between the limits of movement of the corresponding magnet and in the same sense for both magnets.

* * * * *